US006494333B2

(12) United States Patent
Sasaki et al.

(10) Patent No.: US 6,494,333 B2
(45) Date of Patent: Dec. 17, 2002

(54) HEAT-RESISTANT HOLLOW CONTAINER

(75) Inventors: Masaaki Sasaki, Matsudo (JP); Takao Iizuka, Matsudo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 09/837,202

(22) Filed: Apr. 19, 2001

(65) Prior Publication Data

US 2002/0020687 A1 Feb. 21, 2002

(30) Foreign Application Priority Data

Jul. 30, 1999 (JP) ..... 11-218174

(51) Int. Cl.[7] ..... B65D 90/02
(52) U.S. Cl. ..... 215/384; 215/379; 215/381
(58) Field of Search ..... D9/530, 539, 533, D9/536, 553; 220/669; 215/384, 379, 381, 382

(56) References Cited

U.S. PATENT DOCUMENTS

D278,978 S * 5/1985 Franchi et al. ..... D9/539
4,804,097 A * 2/1989 Alberghini et al. ..... 215/384
5,226,550 A * 7/1993 Mikolaitis et al. ..... 215/384
5,279,433 A * 1/1994 Krishnakumar et al. .... 215/381
D352,238 S * 11/1994 Vailliencourt et al. ..... D9/434
5,407,086 A * 4/1995 Ota et al. ..... 215/384
5,472,105 A * 12/1995 Krishnakumar et al. .... 215/384
D402,563 S * 12/1998 Prevot et al. ..... D9/538
6,036,037 A * 3/2000 Scheffer et al. ..... 215/381

FOREIGN PATENT DOCUMENTS

JP 2-191156 A 7/1990
JP 7-223254 A 8/1995

* cited by examiner

*Primary Examiner*—Lee Young
*Assistant Examiner*—Tri M. Mai
(74) *Attorney, Agent, or Firm*—Oliff & Berridge, PLC

(57) ABSTRACT

A heat-resistant hollow cylindrical container comprising a neck, a shoulder, an upper body, a middle body provided with pressure reduction absorbing panels, and a lower body including a bottom wall, wherein said pressure reduction absorbing panels are arranged symmetrically relative to a central axis of the container, each of said pressure reduction absorbing panels is located inside an imaginary outer periphery of the cylindrical shape of the container, and each of said pressure reduction absorbing panels is provided with at least a pair of protuberances to be hooked by a finger. The middle body is provided with two pressure reduction absorbing panels arranged symmetrically respective to the central axis of the container. Said protuberances form a gap therebetween, and have a width and a height so sized as to allow a finger tip to be placed into the gap. Said middle body is also provided with groove-shaped ribs arranged along the upper and lower edges of thereof to absorb changes in an internal pressure in the container. Each of said groove-shaped ribs has an eccentric profile with a depth gradually decreasing to become nil in one of the lateral sides of the body.

10 Claims, 9 Drawing Sheets

HEAT-RESISTANT HOLLOW CONTAINER

BACKGROUND OF THE INVENTION

This invention relates to a heat-resistant hollow container made of synthetic resin and formed by biaxially oriented blow-molding. More particularly, the present invention relates to a heat-resistant container made of synthetic resin and provided with projected sections on the wall thereof so as to be easily hooked by finger tips without forming a handle on the container body.

In recent years, since juice and other beverages are consumed by a large volume to reflect the changes in peoples life styles, containers made of synthetic resin and showing various different profiles are produced to contain such beverages. Some of such containers are very large, and become too heavy when filled with liquid, so that sometimes it can be too cumbersome and inconvenient to carry them and handle them otherwise.

In an attempt to eliminate the inconvenience, some large containers are provided with a handle on the body of the container, so that it may be easily carried by hand.

Large hollow containers for containing detergents and oil that do not need to be hot-filled are normally made of polyethylene or vinyl chloride resin, and formed by blow molding. It is easily to mold such a container with a handle integrally fitted to the container body by blow molding.

However, it is stipulated by law that containers for containing juice and other beverages need to be hot-filled and sterilized for the purpose of food sanitation, and therefore such hollow containers are required to be heat-resistant.

In recent years, heat-resistant containers are generally made of polyethylene-terephthalate (PET) resin and formed by blow molding in view of the safety of food, appearance including transparency, lightweight and mechanical strength.

However, to the contrary of the case of molding a hollow container from polyethylene or vinyl chloride resin, it is very difficult to mold a hollow container of PET resin integrally with a handle by blow molding, because of the properties of the resin and the process required to make the container heat-resistant.

Therefore, currently available containers of PET resin are normally prepared by injection molding a handle in advance, and then by insert molding the container with the handle, so as to attach the handle to the container body.

Japanese Patent Laid-Open No. 2-191156 discloses a heat-resistant container made of PET resin and provided with a handle, which is currently known as typical container of the type under consideration. FIG. 9 of the accompanying drawings illustrates a container 50 as disclosed in the above Laid-Open No. 2-191156. Referring to FIG. 9, a handle 51 comprises a grip 52 and a pair of arms 53, 53 projecting horizontally from opposite ends of the grip 52, and each of the arms 53 is provided at the other end thereof with a projection 54. The handle 51 is attached to a recess 55 provided at an upper portion of the container. The recess 55 is provided with a securing recess 55 at an innermost of thereof. The projection 54 is engaged with the securing recess 55, so that an outer surface of the handle 51 is flush with an outer surface of the body of the container.

While a container provided with such handle shows a simple profile and a simple structure so that it can be molded with ease, when the container is inadvertently dropped on the floor with the handle facing downwardly during transportation or in use, the projecting ends of the arms of the handle tends to push the container body to break the body.

Japanese Patent Laid-Open No. 7-223254 discloses a container realized by improving the handle of the above patent document as shown in FIG. 10. Referring to FIG. 10, a container 60 is provided with a recess 67 at an upper portion of a body. Each of an upper lateral wall and a lower lateral of the recess 67 is provided with an engaging hole. The recess 67 of the container is also provided with a central vertical groove. A handle 61 comprises a grip plate 62, an upper securing arm 63*a* extended forwardly from an upper end of the grip plate, a lower securing arm 63*b* extended forwardly from a lower end of the grip plate, and a securing beam plate 65. The upper securing arm 63*a* is provided with an upward projection 64*a*. The lower securing arm 63*b* is provided with a downward projection 64*b*. The handle 61 is attached to the container by engaging the securing arms 63*a*, 63*b* with the engaging holes. The securing beam plate 65 is engaged with the central vertical groove. When forming the container with the handle, the handle 61 is arranged in a metal mold, a preform of PET resin is arranged in the mold, and then the preform is blow-molded by insert molding to form the container 60 with the handle.

Since the handle as disclosed in the latter patent document is attached to the container by insert molding in such a way that the securing beam plate and the securing arms of the handle engage respectively with the central vertical groove and the upper and lower engaging holes, the handle does not become loose nor come off from the right position. Additionally, since the securing beam plate 65 connects the upper and lower securing arms 63*a*, 63*b*, the distance between the arms 63*a* and 63*b* is maintained, and therefore does not push the container body, so as not to break the container when the container is inadvertently dropped on the floor with the handle facing downwardly during transportation or in use.

However, the above described known containers are not necessarily easy to grasp. A container provided with a handle is easy to grasp only when the grip portion of the handle is large enough for the four fingers of a hand to be snugly placed there, and in other words, the container should be large. However, the container body of the above described containers cannot always provide a room large enough for receiving such a handle.

Meanwhile, most popular containers for containing juice and other beverages are heat-resistant, and have a profile which is basically that of a cylinder or that of a polygonal prism with a capacity of 1.5 liters or less. Such containers need to satisfy various requirements in terms of the shape, the height and the overall size of the container, the surface area of the pressure reduction absorbing panels and the strength and the ease of molding of the container, so that the handle has to be subjected to a number of restrictions. In other words, the handle is not allowed to take a sufficient space, and is normally required to be minimized particularly when the container is intended to be placed on a display shelf.

Therefore, such container with such handle, particularly a cylindrical container with such handle, designed to meet the above requirements is not necessarily grasped by hand with ease.

In order to attach the handle to the container body, it is necessary to mold the handle and then to insert-mold them. Thus, a complex molding apparatus needs to be installed to involve a number of molding steps and high manufacturing cost.

Additionally, most containers provided with a handle fitted thereto by the above described method are designed to be filled with liquid at or near room temperature or, if hot-filled, with liquid heated to 75° C. at most. Heat-resistant containers that are designed to be filled with liquid heated to about 85° C. are not available at present.

This is because it is difficult to uniformly heat-set the undercut portions where the handle having a complex profile is attached to the body of the PET container. Thus, if such container is filled with liquid of very high temperature, the undercut portion tends to be thermally deformed to disengage the handle from the container.

When filling heat-resistant PET resin containers with juice or some other beverage, the containers have to be hermetically sealed immediately after the filling operation, and then heated for sterilization typically in a pasteurizer for food sanitation. Then, if PET resin container has relatively low rigidity, the container tends to be deformed when cooled after the heating process because of the reduced internal pressure produced by the cooled content.

Deformed containers obviously lose some of the commercial value because of the poor appearance and, therefore, containers are normally provided in the body wall thereof with a pressure reduction absorbing panels (walls) in order to prevent such deformation.

Most popularly available heat-resistant containers adapted to withstand temperature as high as 85° C. have a cylindrical profile, because such a profile provides excellent moldability and pressure resistance.

Therefore, hollow cylindrical containers are generally provided with four or six pressure reduction absorbing panels arranged on the body wall of the container as shown in FIG. 7 or 8 in order to absorb changes in the internal pressure.

FIG. 7 shows a hollow cylindrical container 11 comprising a neck 12, an upper body 14, a middle body 15 and a bottom 16, wherein the middle body 15 is provided with deformable pressure reduction absorbing panels 15*a* in order to absorb decrease of internal pressure. Pressure reduction absorbing panels having such a profile can absorb the decrease in the internal pressure to a large extent. FIG. 8 shows a hollow cylindrical container 21 comprising a neck 21, an upper body 24, a middle body 25 and a bottom 26, wherein a large number of deformable protuberances 25*a* are arranged as pressure reduction absorbing panels in the middle body in order to increase an amount of absorption of decrease of internal pressure.

The above described known containers do not provide any gripping problem so long as they have a capacity of 500 milliliter or less, but become to be gripped less easily by a single hand when the capacity exceeds a liter. If the user tries to grip such a large container by a single hand, it tends to slip out of hand and drop. Therefore, the user may have to hold it with two hands to a great inconvenience on the part of the user.

SUMMARY OF THE INVENTION

In view of the above described circumstances, it is therefore the object of the present invention to provide a hollow heat-resistant container (particularly, a hollow cylindrical heat-resistant container) without a handle fitted to the body of the container and with a profile easily held by a single hand.

According to the invention, the above object is achieved by providing a heat-resistant hollow cylindrical container comprising a neck, a shoulder, an upper body, a middle body provided with pressure reduction absorbing panels, and a lower body including a bottom wall, wherein said pressure reduction absorbing panels are arranged symmetrically relative to a central axis of the container, each of said pressure reduction absorbing panels is located inside an imaginary outer periphery of the cylindrical shape of the container, and each of said pressure reduction absorbing panels is provided with at least a pair of protuberances to be hooked by a finger. The middle body is provided with two pressure reduction absorbing panels arranged symmetrically respective to the central axis of the container.

Also, there is provided a heat-resistant hollow cylindrical container comprising a neck, a shoulder, an upper body, a middle body provided with pressure reduction absorbing panels, and a lower body including a bottom wall, wherein said middle body comprises a front pressure reduction absorbing panel, a rear pressure reduction absorbing panel, a left side surface and a right surface, said pressure reduction absorbing panels are arranged symmetrically relative to a central axis of the container, each of said pressure reduction absorbing panels is located inside an imaginary outer periphery of the cylindrical shape of the container, and each of said pressure reduction absorbing panels is provided with at least a pair of protuberances to be hooked by a finger.

Said protuberances form a gap therebetween, have a width and a height so sized as to allow a finger tip to be placed into the gap.

Said middle body is provided with groove-shaped ribs arranged along the upper and lower edges of thereof to absorb changes in an internal pressure in the container. Each of said groove-shaped ribs has an eccentric profile with a depth gradually decreasing to become nil in one of the lateral sides of the body.

Therefore, according to the invention, the container is easily held or grasped by a single hand, has a high heat-resistance by absorbing the change of the internal pressure in the container.

DESCRIPTION OF THE PREFERRED EMBODIMENTS

Now, the present invention will be described by referring to the accompanying drawings that illustrate a preferred embodiment of the invention.

A preform showing a predetermined profile is molded from PET resin by means of a known injection molding apparatus, and heated to a temperature for blow molding. Subsequently, the preform is arranged or placed in position in a metal mold of an ordinary blow molding apparatus, and pressurized air is blown into the preform for blow molding to form a container. The container thus obtained is then heat-treated to produce a highly heat-resistant hollow cylindrical container according to the invention.

Figure 1:
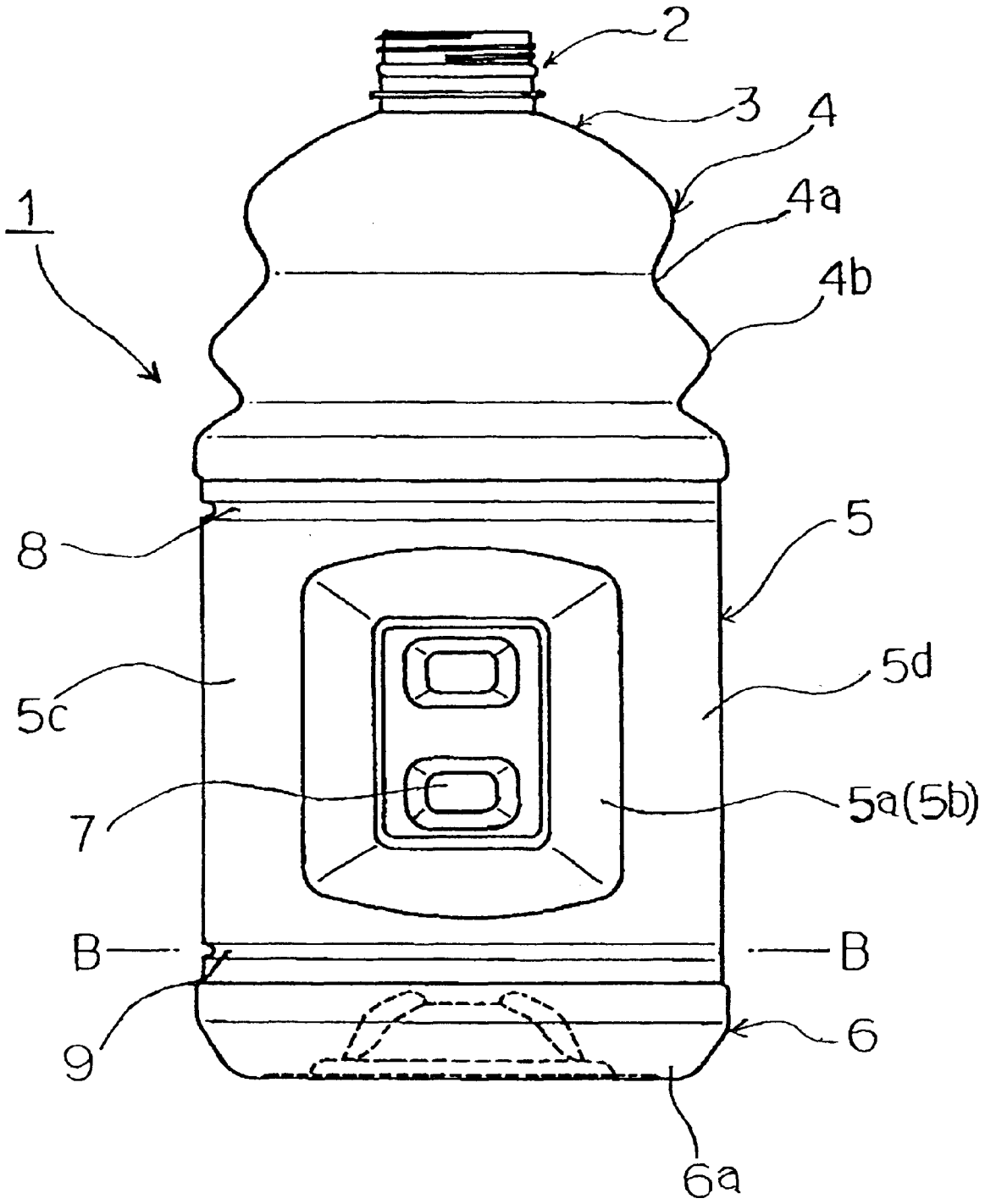
FIG. 1 is a schematic front view of an embodiment of a container according to the invention.
Figure 2:
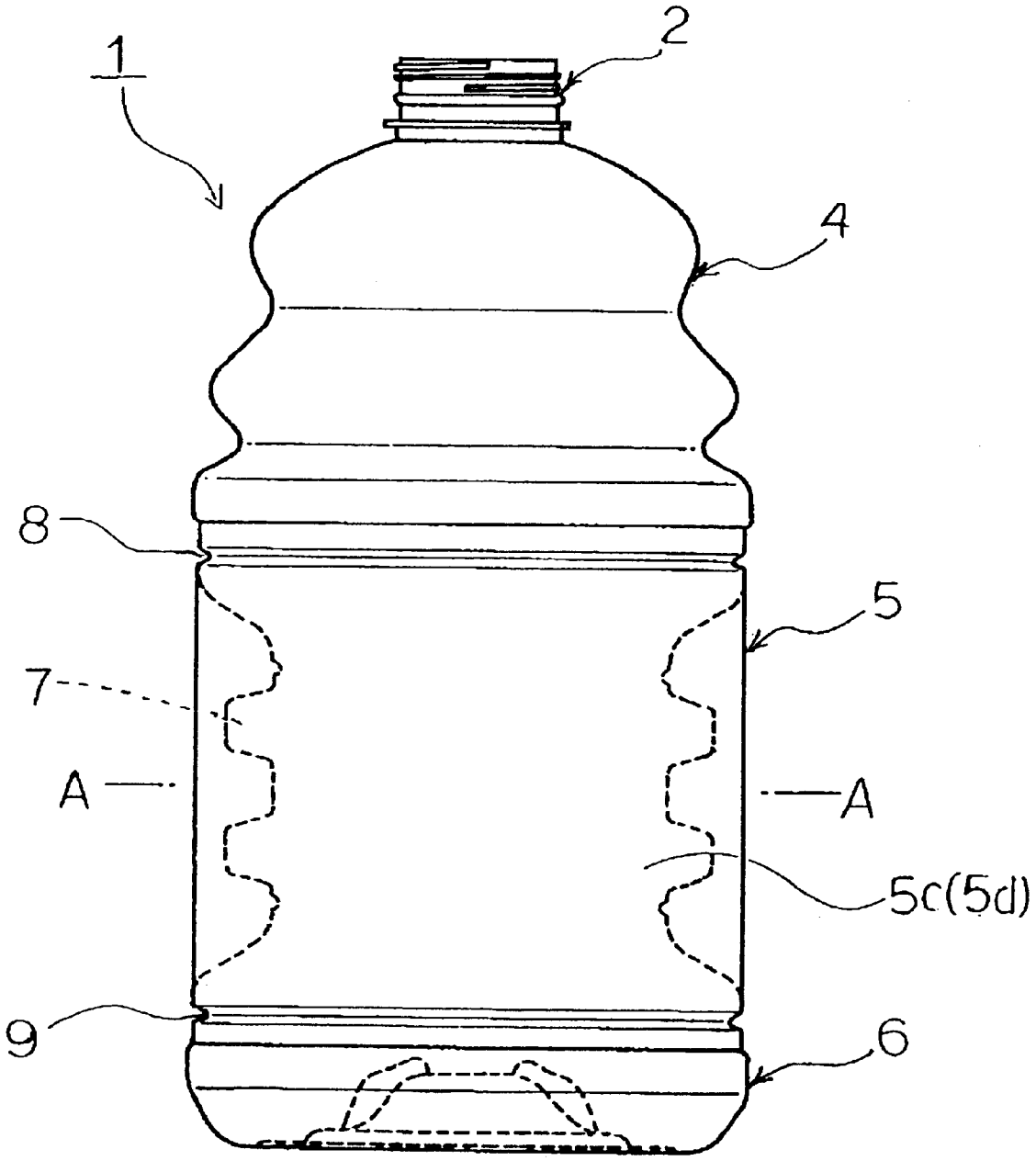
FIG. 2 is a schematic lateral view of the embodiment of FIG. 1.

As shown in FIGS. 1 and 2, a hollow cylindrical container 1 obtained by the above described process comprises a neck 2, a shoulder 3 extending downwardly from the neck 2, an upper body 4 located under the shoulder 3 and provided with a horizontal and a recessed peripheral rib 4*a*, a middle body 5 provided with pressure reduction absorbing panels 5*a*, and a lower body 6 including a bottom wall 6*a* adapted to allow the container stand on itself.

Figure 3:
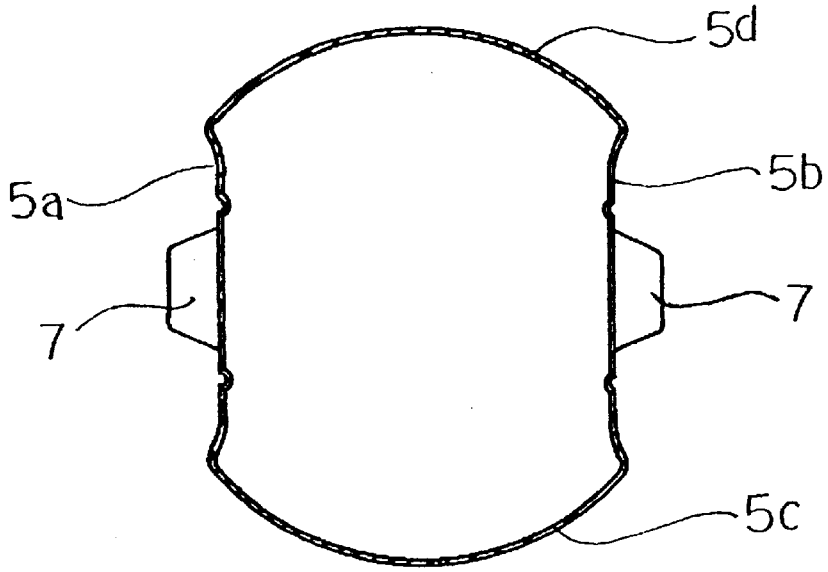
FIG. 3 is a schematic cross sectional view of the embodiment of FIG. 1, taken along line A—A in FIG. 2, without illustrating the bottom.

The middle body 5 of the molded hollow cylindrical container 1 has a front surface and a rear surface, each of which is provided with a pressure reduction absorbing panel 5*a*, 5*b*. Each of the panels 5*a*, 5*b* is located inside an imaginary outer periphery of the cylindrical shape of the container, is symmetrically arranged relative to a central axis of the container, and is provided with protuberances 7. Each of the panels 5*a*, 5*b* is substantially flat as illustrated in FIG. 3. The front surface and the rear surface of the middle body 5 are connected by way of lateral surfaces 5*c*, 5*d*, each of which is curved to form the cylindrical shape and adapted to carry labels for the commodity. In other words, the middle body 5 comprises the front surface with the panel 5*a*, the rear surface with the panel 5*b*, the left side surface 5*c*, and the right side surface 5*d*.

Figure 4:
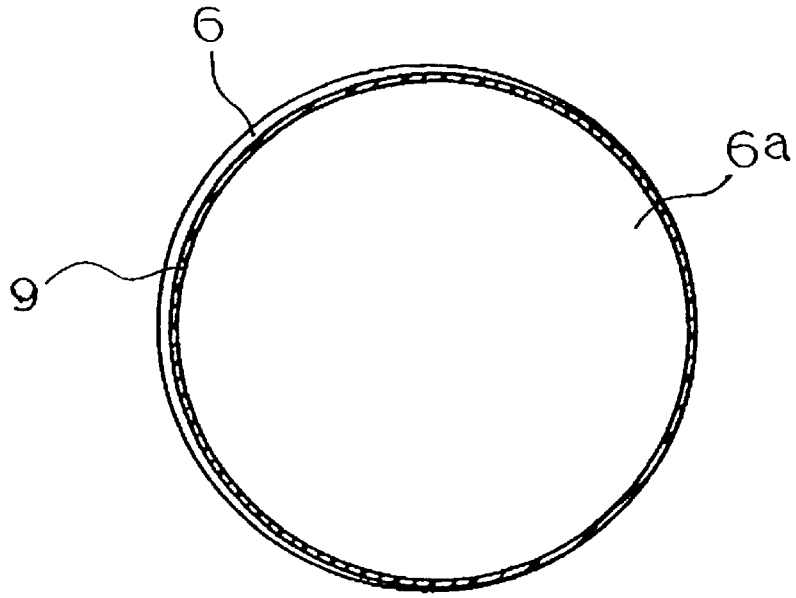
FIG. 4 is a schematic cross sectional view of the embodiment of FIG. 1, taken along line B—B in FIG. 1.
Figure 5:
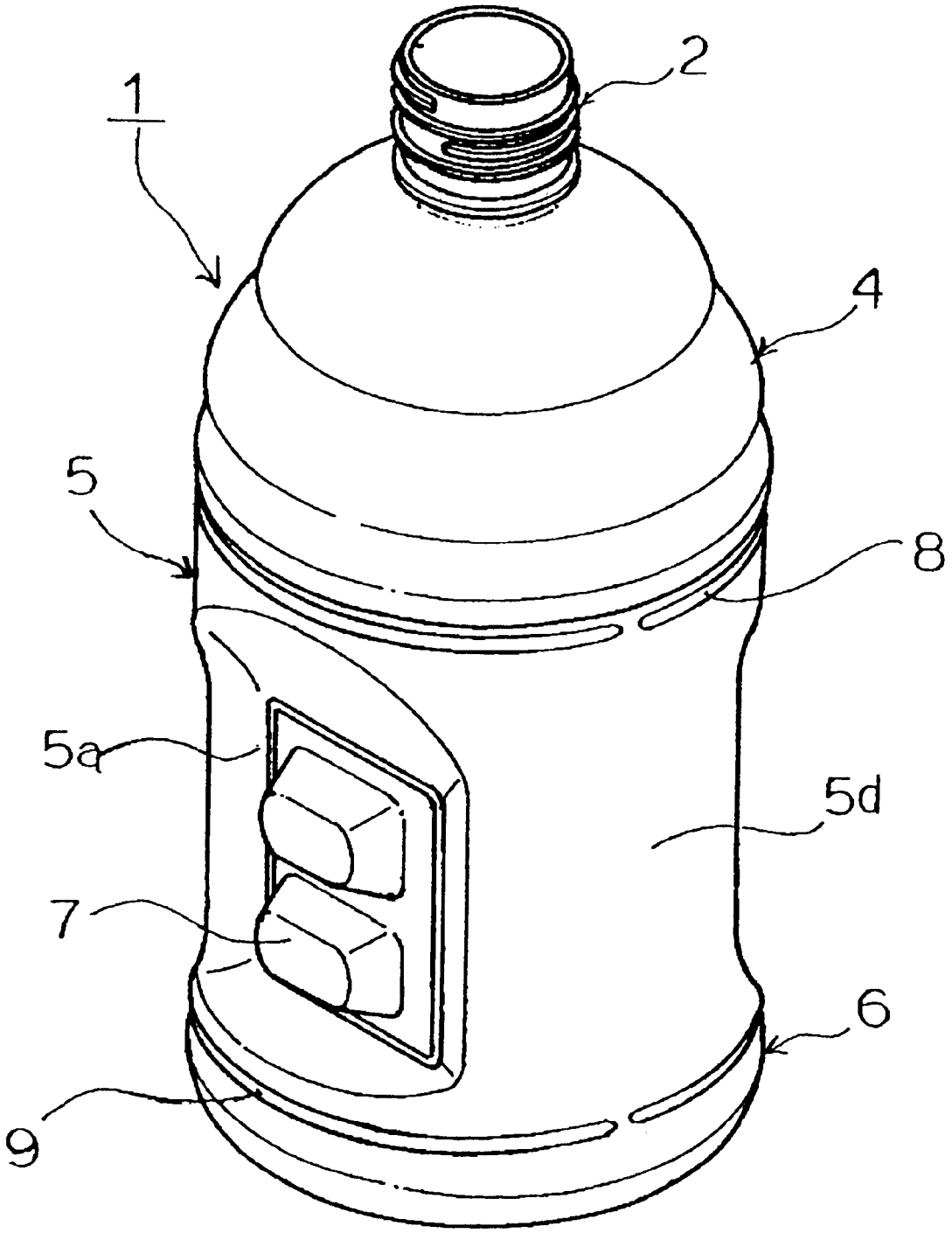
FIG. 5 is a schematic perspective view of the embodiment of FIG. 1.
Figure 6:
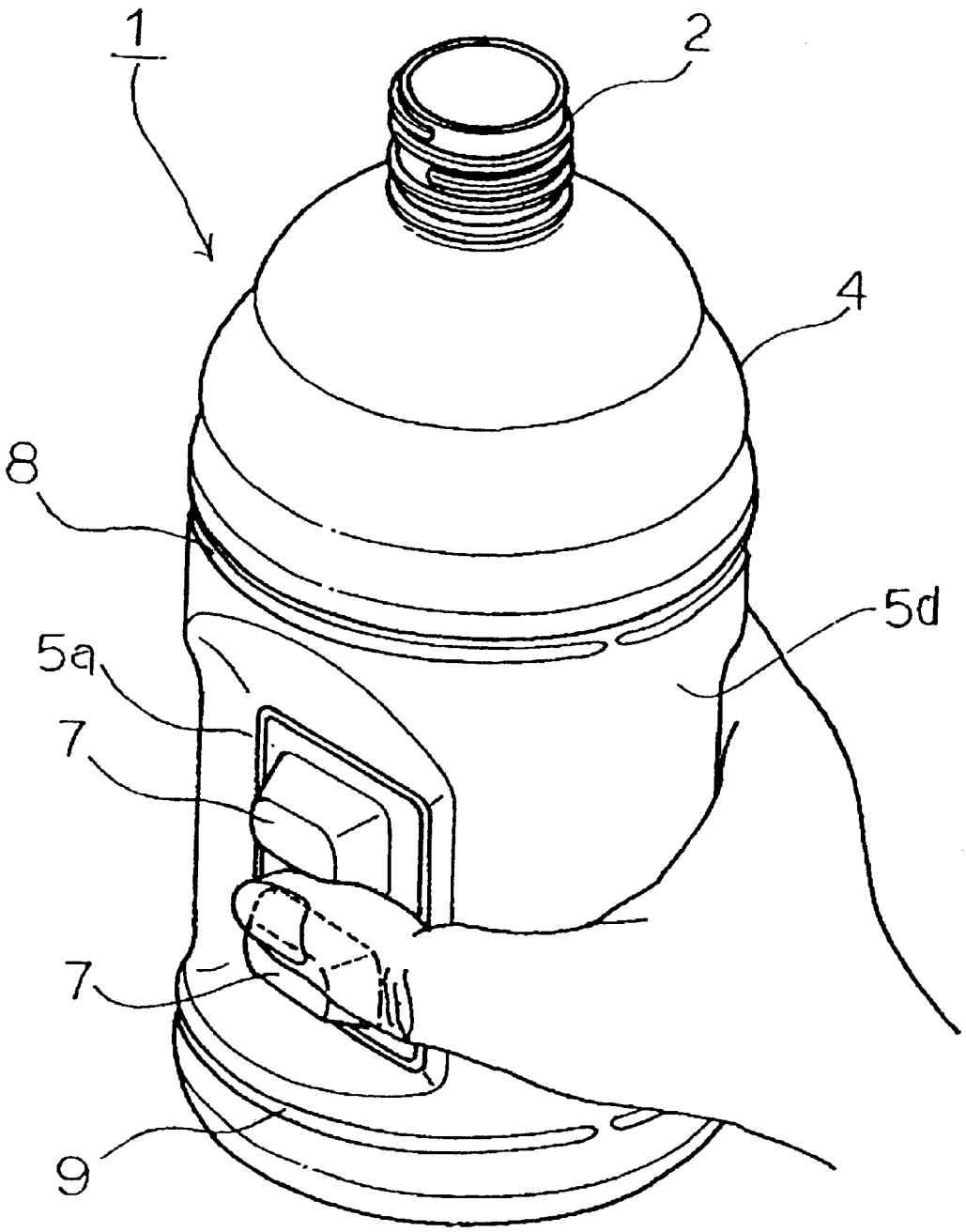
FIG. 6 is a schematic perspective view of the embodiment of FIG. 1 as held by a single hand.
Figure 7:
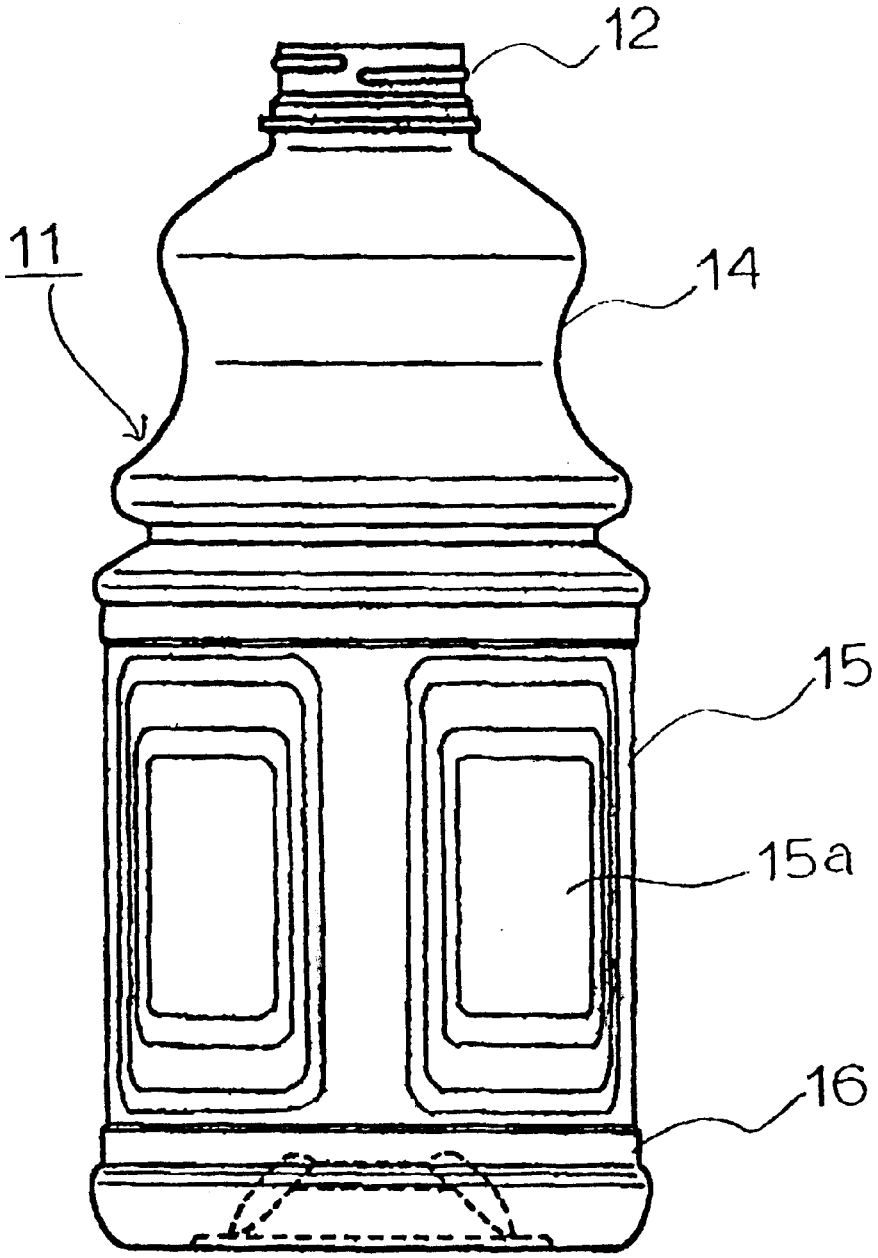
FIG 7 PRIOR ART
FIG. 7 is a schematic front view of a known heat-resistant container.
Figure 8:
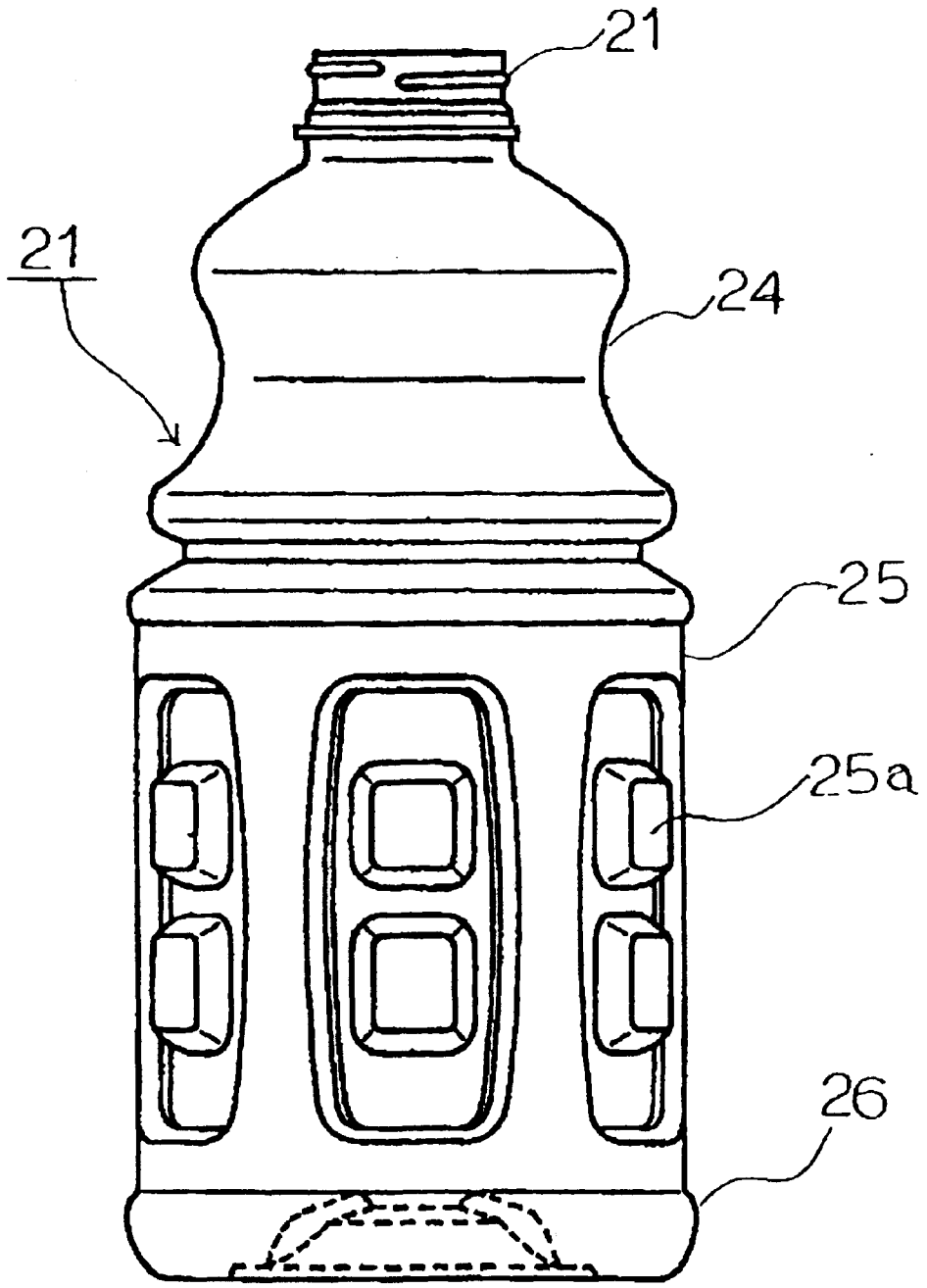
FIG 8 PRIOR ART
FIG. 8 is a schematic front view of another known heat-resistant container.
Figure 9:
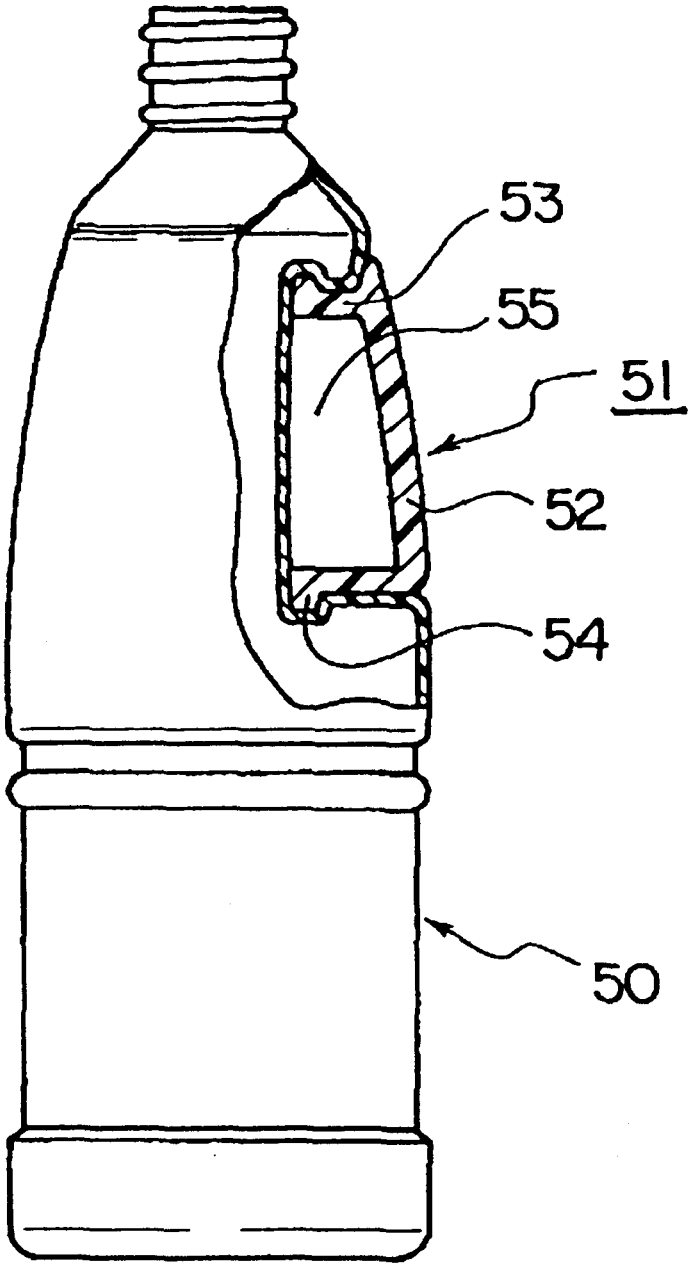
FIG 9 PRIOR ART
FIG. 9 is a schematic lateral view of a known cylindrical container provided with a simple handle.
Figure 10:
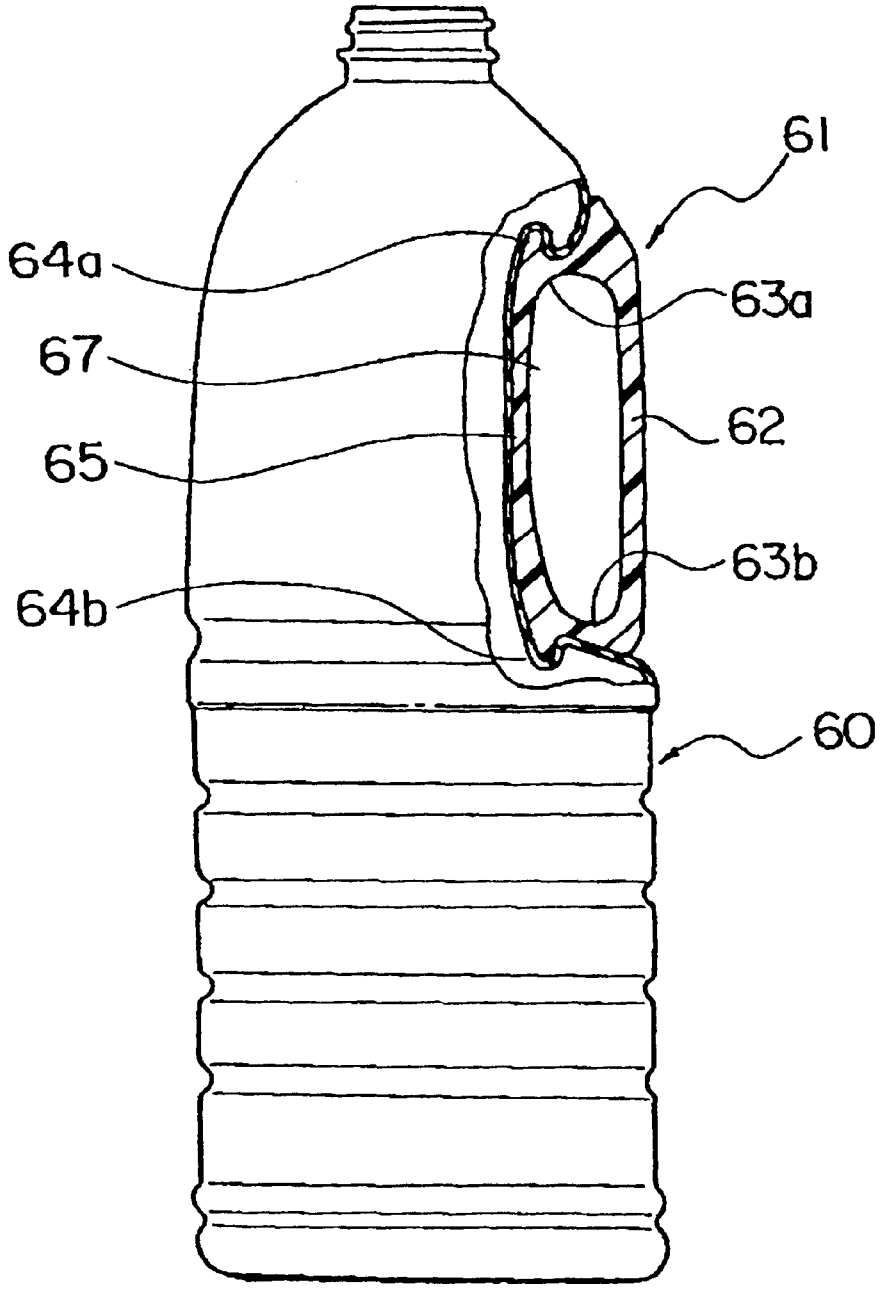
FIG 10 PRIOR ART
FIG. 10 is a schematic lateral view of another known cylindrical container provided with an improved handle.

Each of the pressure reduction absorbing panels 5*a*, 5*b* is provided with at least a pair of protuberances 7 with a gap. Each of the protuberances 7 is protruded outwardly, and has a height or depth (protruded size) to hook a finger, so as to receive the finger between the protuberances 7. Additionally, the middle body 5 is provided along upper and lower edges thereof with groove-shaped ribs 8, 9. A depth of each of the ribs 8, 9 is gradually reduced to become nil at lateral points C, C on one of the label surfaces 5*c*, 5*d*, as illustrated in FIGS. 1 and 4. In other words, each of the ribs 8, 9 is eccentric relative to the cylindrical shape of the body as illustrated in FIG. 4.

The container 1 according to the present invention has the above described configuration and produced by a blow molding process. Thus, at the portion provided with the pressure reduction absorbing panels, the container has a diameter suitably held by hand, in other words, a reduced diameter suitably for grasp by hand. In addition, the container according to the present invention can be entirely and uniformly heat set in a heat treatment process, so that the hollow cylindrical container 1 can absorb changes in the internal pressure and show an enhanced degree of heat-resistance.

When the hollow cylindrical container 1 is hot-filled with juice or some other beverage and pasteurized by means of a pasteurizer, the pressure in the container due to the heating process increases. Such increased pressure is firstly absorbed by the pressure reduction absorbing panels 5*a*, 5*b* including the protuberances 7. If the pressure absorption is not sufficient, the increased pressure is subsequently further absorbed by the surfaces 5*d*, because the eccentric peripheral groove-shaped ribs 8, 9 are arranged along the opposite edges of the middle body 5 and only the surface 5*d* is not formed with the ribs 8, 9 so that the surface 5*d* tends to be deformed.

When the container is cooled to reduce the internal pressure after the pasteurization process, the deformed surface 5*d* restores its original shape, and then the protruded deformation of the pressure reduction absorbing panels 5*a*, 5*b* with the protuberances 7 is dissolved so that the panels 5*a*, 5*b* restores its original shape.

When the container filled with juice or some other beverage is marketed and delivered to a consumer for use, the user can easily hold or grasp the cylindrical container 1 by a single hand. More specifically, the user can easily grasp the container by applying the palm to the surface 5*d* of the body of the container, placing the thumb in the gap between the protuberances 7 of one of the pressure reduction absorbing panels, and placing the index finger or the middle finger in the gap between the protuberances 7 of the other panel, so as to hook the upper protuberance by the fingers.

In the container of the present invention, the distance between the pressure reduction absorbing panels is smaller than the diameter of the cylindrical shape of the body, so as to grasp the container by a single hand. Thus, the palm can be tightly applied to a smooth surface of the body wall of the container, and fingers can be put into the corresponding gaps formed between the protuberances to hook or engage the container, so that the container would not slip out of the hand and fall.

If the user has a hand whose thumb and the middle finger or fore finger can be put into the corresponding gaps between the protuberances, he can easily lift the container, regardless of the size of the container itself.

Finally, since a container according to the invention does not require a handle, it can be molded at low cost and made heat-resistant to high temperature during the blow molding process.

What is claimed is:

1. A heat-resistant hollow cylindrical container comprising;

a neck;

a shoulder;

an upper body;

a middle body provided with only two pressure reduction absorbing panels; and a lower body including a bottom wall, wherein said pressure reduction absorbing panels are arranged symmetrically relative to a central axis of the container, each of said pressure reduction absorbing panels is located inside an imaginary outer periphery of the cylindrical shape of the container; and each of said pressure reduction absorbing panels is provided with at least a pair of protuberances arrange vertically along a longitudinal axis that each of said protruberances defines upper side, a lower side and a base side, the base side substantially parallel to the central axis and located between the upper side and the lower side, said upper, lower and base side arranged to substantially encompass a user's finger placed between said protuberances.

2. The heat-resistant hollow cylindrical container according to claim 1, wherein the middle body is provided with two pressure reduction absorbing panels arranged symmetrically respective to the central axis of the container.

3. The heat-resistant hollow cylindrical container according to claim 1, wherein said protuberances form a gap therebetween, and said protuberances have a width and a height so sized as to allow a finger tip to be placed into the gap.

4. The heat-resistant hollow cylindrical container according to claim 1, wherein said middle body is provided with groove-shaped ribs arranged along the upper and lower edges of thereof to absorb changes in an internal pressure in the container.

5. The heat-resistant hollow cylindrical container according to claim 4, wherein each of said groove-shaped ribs has an eccentric profile with a depth gradually decreasing to become nil.

6. A heat-resistant hollow cylindrical container comprising:

a neck;

a shoulder;

an upper body;

a middle body provided with only two pressure reduction absorbing panels; and a lower body including a bottom wall, wherein said middle body comprises a front pressure reduction absorbing panel, a rear pressure reduction absorbing panel, a left side surface and a right surface, said pressure reduction absorbing panels are arranged symmetrically relative to a central axis of the container, each of said pressure reduction absorbing panels is located inside an imaginary outer periphery of the cylindrical shape of the container, and each of said pressure reduction absorbing panels is provided with at least a pair of protuberances arrange vertically along a longitudinal axis that each of said protuberances defines an upper side, a lower side and a base side, the base side substantially parallel to the central axis and located between the upper side and the lower side, said upper, lower and base side arranged to substantially encompass a user's finger placed between said protuberances.

7. The heat-resistant hollow cylindrical container according to claim 6, wherein said protuberances form a gap therebetween, and said protuberances have a width and a height so sized as to allow a finger tip to be placed into the gap.

8. The heat-resistant hollow cylindrical container according to claim 6, wherein said middle body is provided with groove-shaped ribs arranged along the upper and lower edges of thereof to absorb changes in an internal pressure in the container.

9. A heat-resistant hollow cylindrical container comprising:

a neck;

a shoulder;

an upper body;

a middle body provided with only two pressure reduction absorbing panels; and a lower body including a bottom wall, wherein said pressure reduction absorbing panels are arranged symmetrically relative to a central axis of the container, each of said pressure reduction absorbing panels is located inside an imaginary outer periphery of the cylindrical shape of the container;

each of said pressure reduction absorbing panels is provided with at least a upper side, a lower side and a base side, the base side substantially parallel to the central axis and located between the upper side and the lower side, said upper, lower and base side arranged to substantially encompass a user's finger placed between said protuberances; and said middle body is provided with a groove arranged along upper and lower edges thereof and extending substantially around the circumference of the middle body, each groove having a depth gradually decreasing to nil.

10. The heat-resistant hollow cylindrical container according to claim 8, wherein each of said groove-shaped ribs has an eccentric profile with a depth gradually decreasing to become nil in one of the lateral sides of the body.

* * * * *